US008156768B2

(12) United States Patent
Green et al.

(10) Patent No.: US 8,156,768 B2
(45) Date of Patent: Apr. 17, 2012

(54) SYSTEM AND METHOD OF FORMING A TOE SEAM

(75) Inventors: David H. Green, Winston-Salem, NC (US); Howard Van Saunders, Troy, NC (US); Thurmond Rufus Vaughn, Mt. Airy, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 386 days.

(21) Appl. No.: 12/505,732

(22) Filed: Jul. 20, 2009

(65) Prior Publication Data

US 2011/0192198 A1 Aug. 11, 2011

(51) Int. Cl.
*D04B 9/56* (2006.01)

(52) U.S. Cl. ..... 66/187; 66/178 R

(58) Field of Classification Search ..... 66/169 R, 66/170, 171, 172 E, 178 R, 179, 182, 202
See application file for complete search history.

(56) References Cited

U.S. PATENT DOCUMENTS

| | | | | |
|---|---|---|---|---|
| 2,180,593 | A | 11/1939 | Kugelman et al. | |
| 2,296,302 | A | 9/1942 | Weisbecker et at | |
| 2,409,138 | A | 10/1946 | Mack | |
| 2,968,937 | A * | 1/1961 | Margulies | 66/187 |
| RE24,971 | E * | 4/1961 | Getaz | 66/172 R |
| 2,980,917 | A * | 4/1961 | Slane | 2/239 |
| 3,324,686 | A * | 6/1967 | Rosenstein | 66/187 |
| 3,575,019 | A | 4/1971 | Janda | |
| 3,886,876 | A | 6/1975 | Sparso | |
| 4,037,436 | A | 7/1977 | Wehrmann | |
| 4,162,620 | A * | 7/1979 | Raevich et al. | 66/187 |
| 4,571,960 | A | 2/1986 | Hursh et al. | |
| 4,631,755 | A | 12/1986 | Zingg et al. | |
| 5,398,626 | A | 3/1995 | Rosso et al. | |
| 6,158,254 | A | 12/2000 | Richard | |
| 6,158,367 | A | 12/2000 | Jordan et al. | |
| 6,170,089 | B1 | 1/2001 | Marchetti | |
| 6,209,363 | B1 | 4/2001 | Jordan | |
| 7,213,420 | B2 | 5/2007 | Lynch et al. | |
| 7,437,896 | B2 | 10/2008 | Hirao et al. | |
| 2003/0131635 | A1 | 7/2003 | Lynch et al. | |
| 2006/0010931 | A1 | 1/2006 | Lynch et al. | |

OTHER PUBLICATIONS

Unknown article on types of linking; unknown author, title, date; believed to be prior art.

Golden Solution, Knitting International—Jul. 2003, World Textile Publications Ltd., article reprinted at Inteletex.com, Nov. 21, 2008.

New Machines article, Detexomat Hosiery Technology, Textile Automation Sales Ltd. website: textileautomationsales.info/newmachines.html; Nov. 21, 2008.

* cited by examiner

*Primary Examiner* — Danny Worrell

(74) *Attorney, Agent, or Firm* — Womble Carlyle Sandridge & Rice, PLLC

(57) ABSTRACT

An article of hosiery having a toe seam has been developed. The hosiery includes a foot portion and a first circumferential toe portion having a first stitch length. A second circumferential toe portion can be adjacent the first toe portion. The second circumferential toe portion has at least two knitted courses with each of the at least two knitted courses having a second stitch length that is less than the first stitch length. There is at least one thread in the first circumferential toe portion that forms the toe seam.

11 Claims, 13 Drawing Sheets

SYSTEM AND METHOD OF FORMING A TOE SEAM

FIELD OF THE INVENTION

The invention is related to articles of hosiery, and particularly, to the formation of toe seams on articles of hosiery.

BACKGROUND OF THE INVENTION

Wearer comfort is one objective in the design and manufacture of hosiery. One aspect of comfort is related to how the hosiery and toe seam is formed and the intrusiveness (or lack thereof) of the toe seam to a wearer's foot.

Typically, hosiery is formed on circular knitting machines to yield a tubular fabric that requires closure of the toe. Historically, "hand-linking" was used to close the toe and form this seam. This process includes connecting the loops around the periphery of the fabric tube by hand, one at a time, until the toe was closed. This time-intensive process yielded comfortable, relatively non-intrusive seams. The hosiery market, however, encouraged automation in toe seam formation to improve productivity. Automation, however, has not generally yielded as comfortable toe seams as hand-linking.

Modifying the toe seam to improve comfort has been attempted. Using additional seaming threads results in a bulky uncomfortable seam. Placing the seam on the inside or outside of the hosiery has a limited effect on comfort. Manipulation of the knit structure near the seam has not yet achieved the desirable productivity levels while providing the comfort of "hand-linked" toe seams.

Thus, there is a need to provide comfortable, non-intrusive toe seams in an article of hosiery.

DETAILED DESCRIPTION OF THE INVENTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

Figure 1:
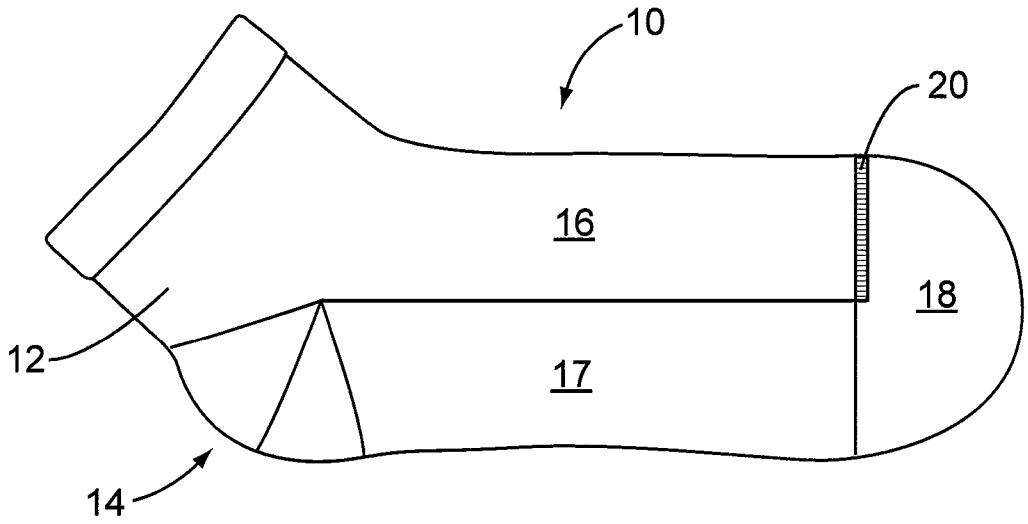
FIG. 1 is a side view of a hosiery article with a toe seam.
Figure 2:
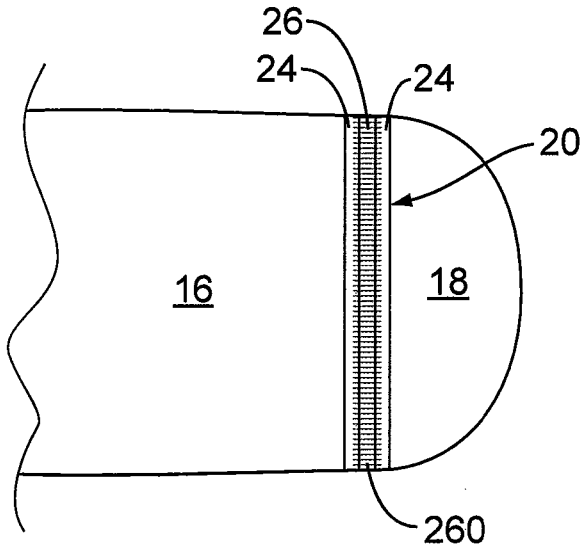
FIG. 2 is a top view of a hosiery article.

FIGS. 1 and 2 show a hosiery article 10 with a toe seam 20. Hosiery refers to a sock, hose, stocking or any circular fabric formed to be worn on the foot or legs of a wearer. The hosiery article 10 has leg 12, heel 14, upper foot portion 16, lower foot portion 17 and a toe 18 with a toe seam 20. The toe seam 20 includes a first circumferential toe portion 24 joined together by a thread 260.

The hosiery 10 may have several types of knit stitches. For example, jersey, rib, terry, tuck and float stitches may be used to form the hosiery article 10. The region near the toe seam 20 has a knit construction designed to provide a comfortable toe seam that is relatively less intrusive to the wearer compared to the surrounding portions of the hosiery article 10. For example, the toe 18 may have jersey, or terry stitches. Further, the toe 18 may be either a reciprocating or plain toe. The heel 14 and the lower foot portion 17 may be formed with a terry, jersey or rib construction, while the leg 12 and upper foot portion 16 may be a rib, single jersey or terry stitch. In alternate embodiments, however, some or all of the parts of hosiery article 10 may have a similar knit construction.

Additional yarns are added to various portions of the hosiery article 10. For example, the second circumferential toe portion 26 has a third yarn 38 that typically may be a continuous filament yarn. The toe clip may be formed of a fourth yarn.

A method of forming hosiery article 10 includes knitting the hosiery article 10 on a circular knitting machine and forming the toe seam 20. In an embodiment, the process of forming the hosiery includes knitting, bleaching, dyeing and finishing, drying, forming the toe seam 20, and packaging. In alternate embodiments, however, the process includes knitting the hosiery, then forming the toe seam 20, bleaching, dyeing and finishing, and packaging. However, the method may be further modified so that the hosiery article is knitted, followed by bleaching, dyeing and finishing, then forming the toe seam 20 and packaging.

Figure 3:
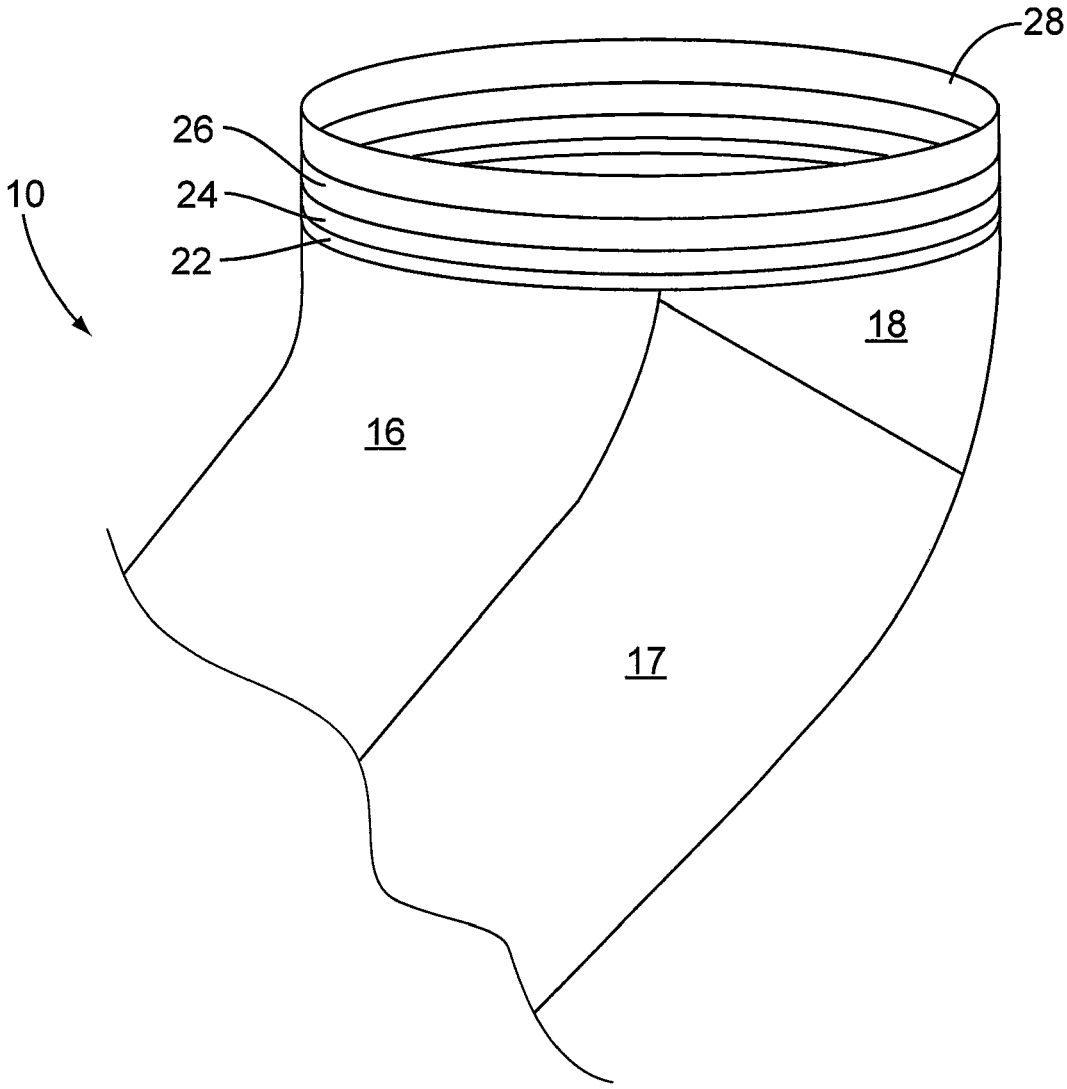
FIG. 3 is a top perspective view of the open toe of a hosiery article prior to formation of a toe seam.
Figure 4:
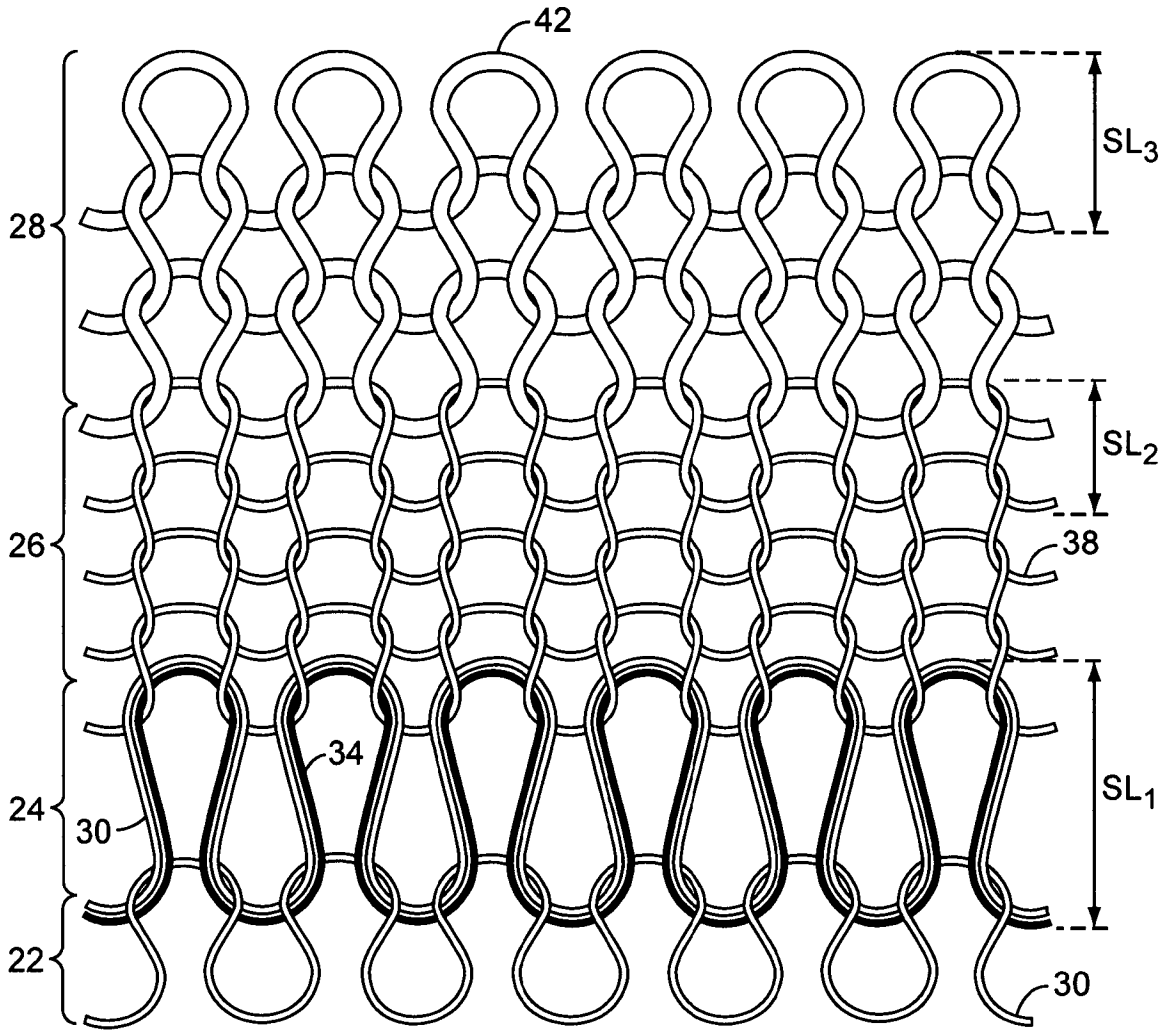
FIG. 4 is a schematic of the knit pattern of an open toe of a hosiery article.

A fabric structure that facilitates formation of the toe seam 20 is shown in FIGS. 3 and 4. The fabric structure has a toe clip 28, second circumferential toe portion 26 and a first circumferential toe portion 24 and an added course 22. The first and second circumferential toe portions 24 and 26 and toe clip 28 facilitate formation of the toe seam 20 during seaming. For example, first circumferential toe portion 24 and toe clip 28 guide the hosiery through the seaming machine while the second circumferential toe portion 26 permits removal of toe clip 28 during seaming.

Several yarns may be used to form the hosiery article 10. In the embodiment shown in FIGS. 1, 2, and 4, first 30, second 34, third yarns 38, and optionally a fourth yarn 42, are used to form the knit fabric.

The first and second yarns 30 and 34 form the first circumferential toe portion 24. The first and second yarns 30 and 34 may be formed using ring-spinning, open-end spinning, air jet spinning, continuous filament, or other yarn formation systems. The first and second yarns 30 and 34 can be formed from a single fiber type. For example, the first and second yarns can be formed from cotton, wool, rayon, polyester, polyamides (e.g. Nylon), polylactic acid (PLA), or polyolefin fibers. In alternate embodiments, the first and second yarns can be formed from an intimate blend of two or more fiber types, such as, but not limited to cotton, wool, rayon polyester, polyamides (e.g. Nylon), polylactic acid (PLA), polyolefin. For example the first and second yarns 30 and 34 can be formed from intimate blends of cotton fibers and polyester fibers. In other embodiments, the first yarn 30 may be a plied yarn and the second yarn 34 may be a plied yarn.

The first and second yarns 30 and 34 may have a linear density between about 4/1 cc and 40/1 cc, preferably between about 6/1 and 20/1 cc. The yarns can have an equivalent linear density where plied yarns are used, as is known in the art. The first yarn 30 may be a ring-spun yarn formed from cotton fibers or other fibers as described above. The second yarn 34 may also be a ring-spun yarn from cotton fibers or other fibers as described above. The linear density of the first and second yarns 30 and 34 may depend on the weight and construction of the hosiery article 10.

The third yarn 38 forms the second circumferential toe portion 26. In the embodiment shown in FIG. 4, the third yarn 38 is a continuous filament yarn. In other alternate embodiments, the third yarn 38 is selected from the group consisting of a continuous filament yarn, a textured continuous filament yarn, a core spun yarn or a spun yarn. The third yarn 38 may be a fiber selected from the group including, but not limited to polyester, polyamides (e.g. Nylon), or polyolefins. The third yarn 38 can have a linear density between about 40 denier and about 280 denier.

The stitch length of each portion of the knit fabric may be different. In the embodiment shown, the first toe portion 24 has a first stitch length ($SL_1$) and the second toe portion 26 has a second stitch length ($SL_2$). The first stitch length ($SL_1$) is greater than the second stitch length ($SL_2$). The toe clip 28 may have a third stitch length ($SL_3$) that is less than the first stitch length ($SL_1$). As used herein, the stitch length refers to the distance from the lower end of a loop to the top of a loop in the same course.

The leg 12, heel 14 and upper and lower foot portions 16 and 17 are formed on a circular knitting machine. The fabric structure first forms an "added" course 22 with a plain jersey stitch following the formation of the upper and lower foot portions 16 and 17. The added course 22 may include 2, 3 or 4 or more knitted courses. The added course 22 provides separation between the foot portions (16 and 17) and first circumferential toe portion 24.

The first circumferential toe portion 24 is formed with first and second yarns 30 and 34 in a plaited relationship. The first yarn 30 may be similar to the yarn that forms the leg 12, heel 14 or upper and lower foot portions 16 and 17. The second yarn 34 provides added bulk to the first circumferential toe portion 24.

Adjacent to the first circumferential toe portion 24 is a second circumferential toe portion 26. The second circumferential toe portion 26 may include 3, 4 or 5 knitted courses. In a preferred embodiment, the second circumferential toe portion 26 has 4 knitted courses. In an alternate embodiment, the second toe portion 26 may have fewer knitted courses. For example, the second circumferential toe portion 26 may have fewer courses when forming a toe seam 20 immediately following the knitting step and prior to the bleaching and dying steps.

The second circumferential toe portion 26 is formed with a third yarn 38 selected to minimize extension therein. In an embodiment, the third yarn is different from either of the first 30 or second 34 yarns. In a preferred embodiment, a non-elastomeric yarn is used.

The toe clip 28 is formed adjacent to the second circumferential toe portion 26. The structure of the toe clip 28 generally provides added bulk to the hosiery, facilitates seam formation and is removed during seaming as described below. A fourth yarn 42 forms the toe clip 28 as shown in FIG. 4. In alternate embodiments, the first yarn 30 and second yarn 34 may be used to form the toe clip 28.

Figure 5:
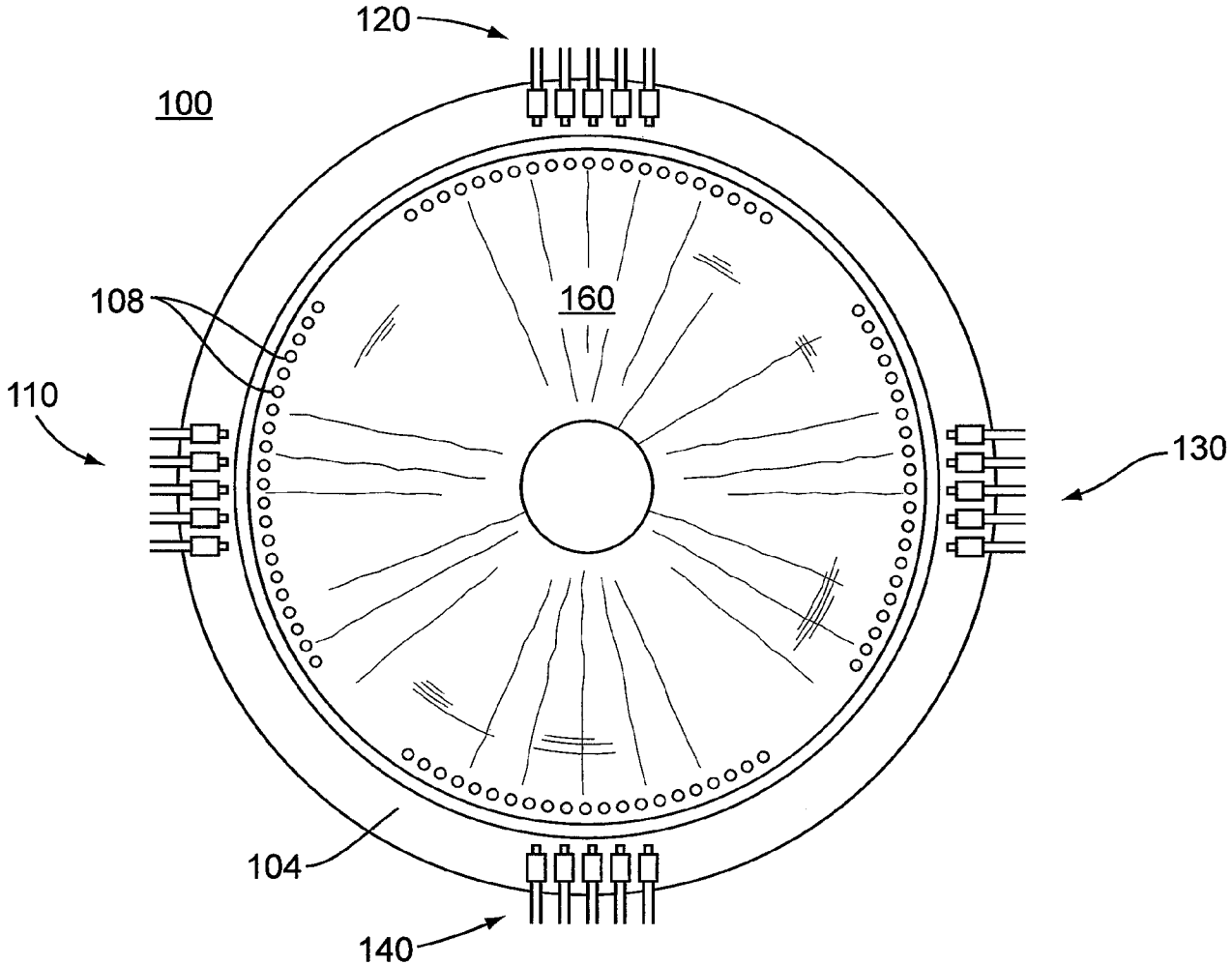
FIG. 5 is a top view of a hosiery article formed on a circular knitting machine.

Formation of hosiery article 10 on circular knitting machine 100 is shown in FIGS. 5 and 6A-6C. In an embodiment, a single cylinder knitting machine may be used. In alternate embodiments, a double cylinder knitting machine may be used. A top view of a circular knitting machine 100 is shown in FIG. 5. The knitting machine 100 has a cylinder 104, knitting needle 106, and first 110, second 120, third 130 and fourth 140 yarn feeds. The yarn feeds are shown proximate the cylinder 104 and needles 106 (shown in an extended position). The selective introduction of the yarns (not shown) to the knitting needle 106 forms the tubular fabric 160.

A four feed machine is shown in FIG. 5. In alternate embodiments, more or less feeds may be used. The knitting machine 100 shown has 108 needles in the cylinder. A portion of the needles 106 are below the fabric 160. In alternate embodiments, however, between about 72 to about 256 needles in the cylinder may be used.

The first and second toe portions 24 and 26, and toe clip 28 are formed with the selective introduction of first 30, second 34, and third 38 yarns during knitting to facilitate formation of the toe seam 20 as shown in FIGS. 6A-6D. The corners of the toe seam 20 have minimal bulk. Bulk is minimized by the selective introduction of first 30, second 34 and third yarns 38 at a lap point 150 of fabric 160 during knitting.

A circular knitting machine 100 forms the first and second circumferential toe portions 24 and 26 and toe clip 28 using only a first yarn feed 110. The leg, heel and foot portions, however, may use several yarn feeds. In the embodiment shown in FIG. 6A, a single yarn feed (110) is used to knit the first and second toe portions 24 and 26, and the toe clip 28. The first yarn feed 100 includes first 112, second 114, third 116, fourth 118 and fifth 119 yarn feeders. Accordingly, the first and second toe portions 24 and 26, and the toe clip 28, may be formed in alternate embodiments using five different yarns.

Figure 6A:
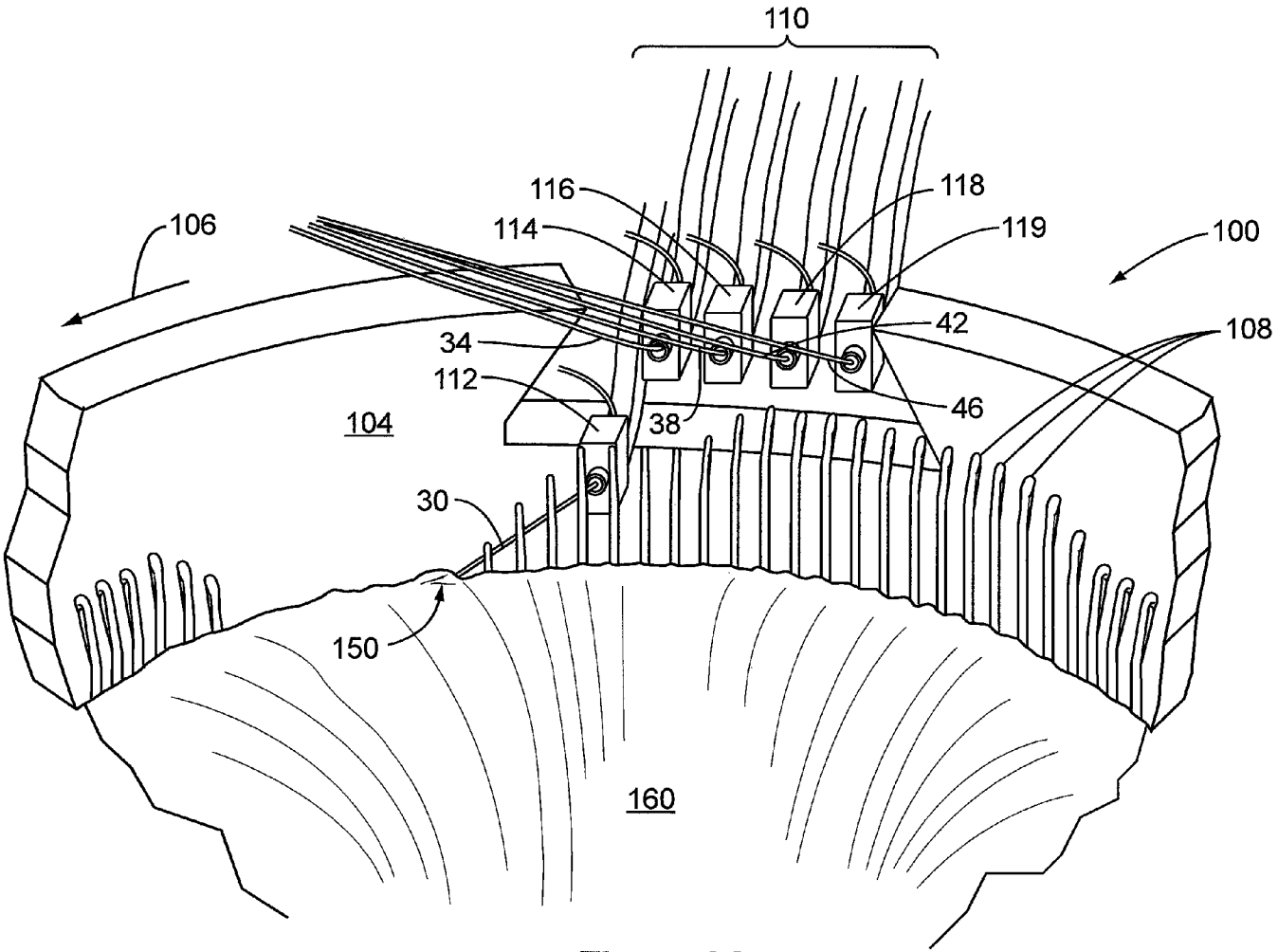
FIGS. 6A through 6D show top perspective views of a segment of a circular knitting machine forming the open toe of a hosiery article.
Figure 6B:
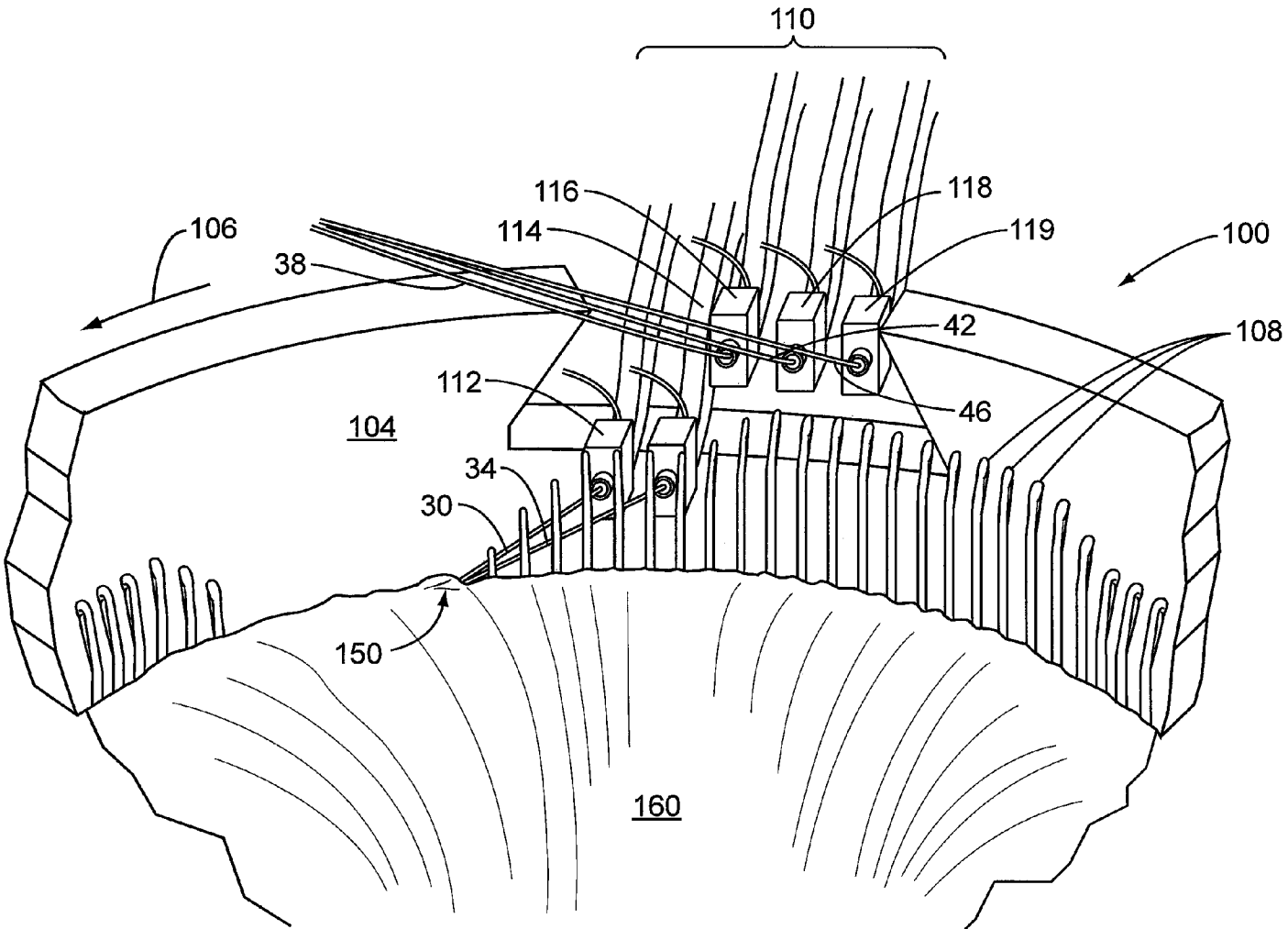

The circular knitting machine 100 rotates the cylinder 104 in a first direction 106 through a typical knitting cycle to form the added course 22 as shown in FIG. 6A. The single rotation of cylinder 104 forms one course of a single jersey stitch with a first yarn 30 introduced to needles by the first yarn feeder 112. The first yarn 30 is introduced to the fabric 160 at a lap point 150. The remaining yarn feeders 114, 116, 118 and 119 remain inactive. At the conclusion of a single rotation of the cylinder 104, the added in course 22 (not shown) is formed and the second yarn 34 is introduced with the second yarn feeder 114 at the lap point 150 to begin formation of the first circumferential toe portion 24.

The single rotation of the cylinder 104 forms the first circumferential toe portion 24. First and second yarns 30 and 34 form a single jersey knit having a first stitch length ($SL_1$). In the embodiment shown in FIG. 6B, the first 30 and second yarn 34 are fed to the needle 106 in a plaited relationship to the needle 106 to increase the bulk of the fabric structure. The second yarn 34, however, is introduced to the fabric 160 by the second yarn feeder 114 at the lap point 150 providing minimal overlap between the added course 22 and the first circumferential toe portion 24. In alternate embodiments, the first circumferential toe portion 24 may include more than one knitted course, and thus more than one rotation of cylinder 104 may be needed for this portion of the hosiery article 10. For example, the first circumferential toe portion 24 can have two, three or more knitted courses.

Figure 6C:
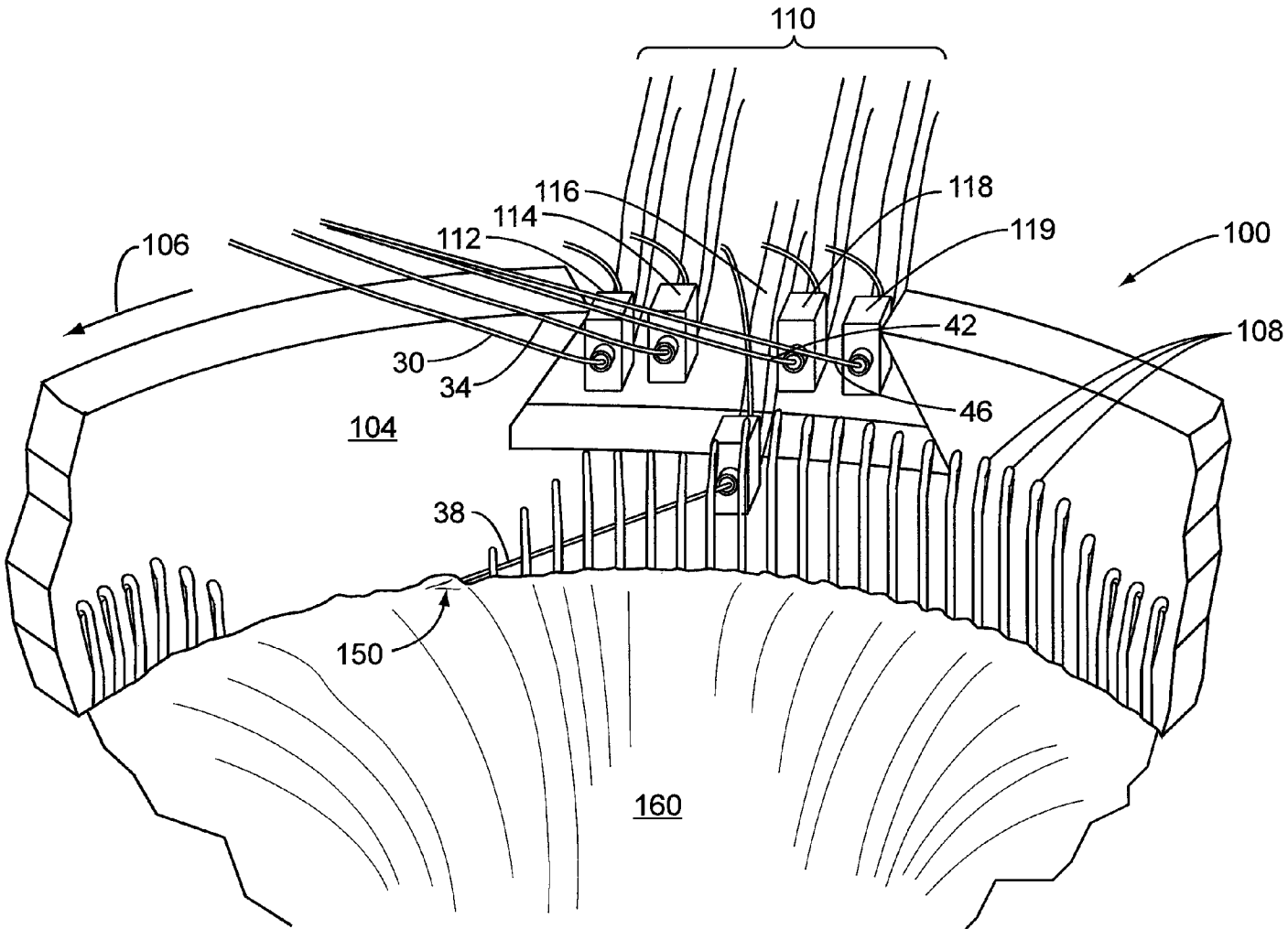
Figure 6D:
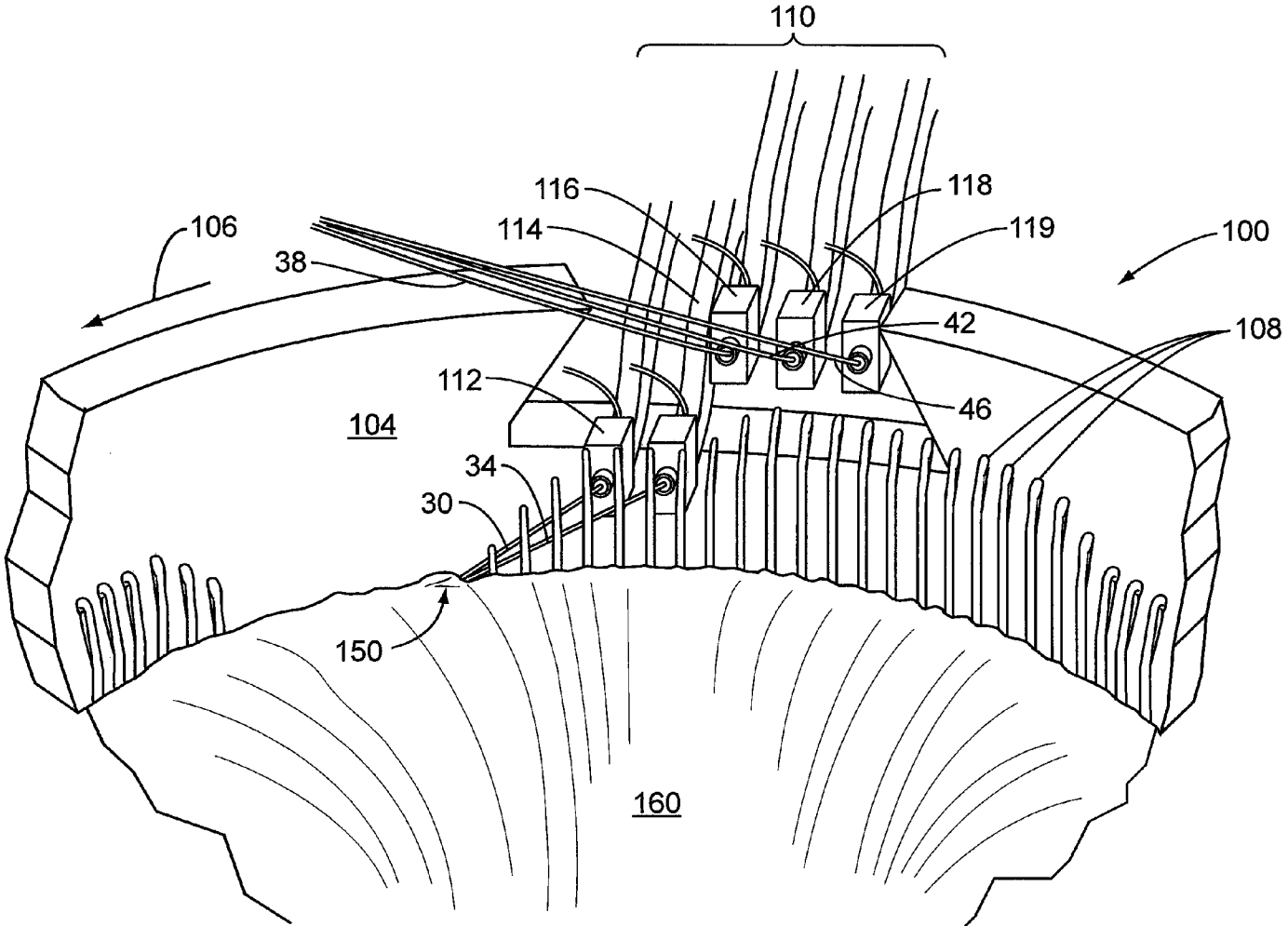

A third yarn 38 is introduced into the fabric 160 at lap point 150 to form second circumferential toe portion 26 as shown in FIG. 6C. A third yarn feeder 116 is selectively lowered to introduce a third yarn 38 to the knitting needle 106 while the first and second yarn feeders 112 and 114 are withdrawn and remain idle during knitting. The knitting machine 100 completes four rotations of the cylinder 104 with the third yarn 38 to form four knitted courses. The second circumferential toe portion 24 is formed with a second stitch length ($SL_2$) (not shown). In alternate embodiments, the second circumferential toe portion 26 may include more or less than four knitted courses, and thus more than four rotations of the cylinder 104. For example, the second circumferential toe portion 26 can have two, three or more knitted courses.

The toe clip 28 follows formation of the second circumferential toe portion 26. The toe clip 28 may have a single jersey stitch. In alternate embodiments, the toe clip 28 may be a jersey or rib stitch or other construction. The toe clip 28 can be formed with any of the first 30, second 34, third 38, or fourth yarns 42. For example, in an embodiment, the first 112 and second 114 yarn feeders introduce first and second yarn 30 and 34 to the needle 106 to form the toe clip 28. In other embodiments, only the fourth yarn feeder 118 introduced the fourth yarn 42 to form the toe clip 28 (an exemplary embodiment is shown in FIG. 4). In other alternate embodiments, the toe clip 28 may be formed with a fifth yarn 46.

Figure 7:
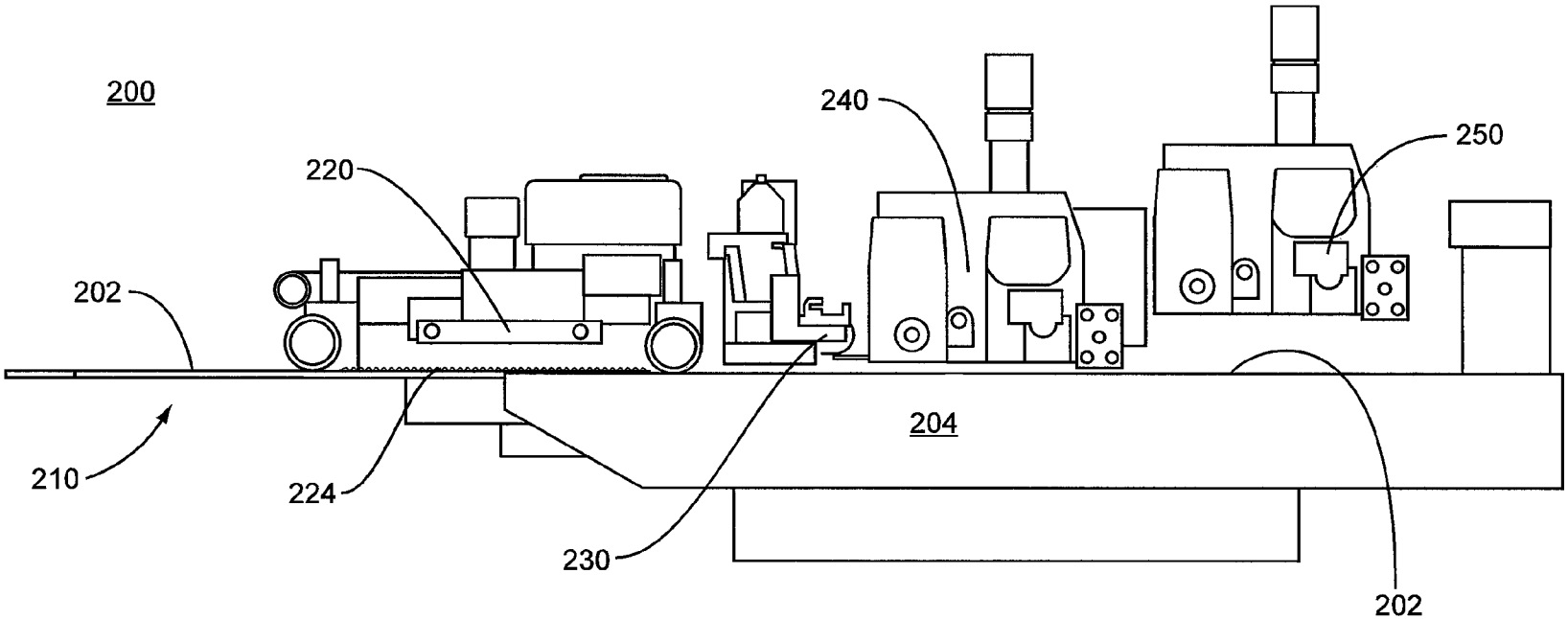
FIG. 7 is a side view of segments of a seaming machine.

The hosiery article 10 is closed on a seaming machine 200 as shown in FIGS. 7 through 8C. The seaming machine 200 includes a pair of guide bars 210, support 204, a feeder 220, a knife 230, and first 240 and second seaming heads 250. The guide bars 210 and a support 204 form a surface 202. The hosiery 10 is introduced into the guide bars 210, received by a feeder 220 and chain 224, and transferred through the knife 230 and first and second seaming heads 240 and 250. In an embodiment, the seaming machine is a Complett 222™ seaming machine available from Conti Complett SpA of Bergamo, Italy. In alternate embodiments, a Rosso seaming machine available from Rosso Industrie SpA of Orbassano, Italy, may be used. In other alternate embodiments, other devices are used to form the toe seam.

Figure 8A:
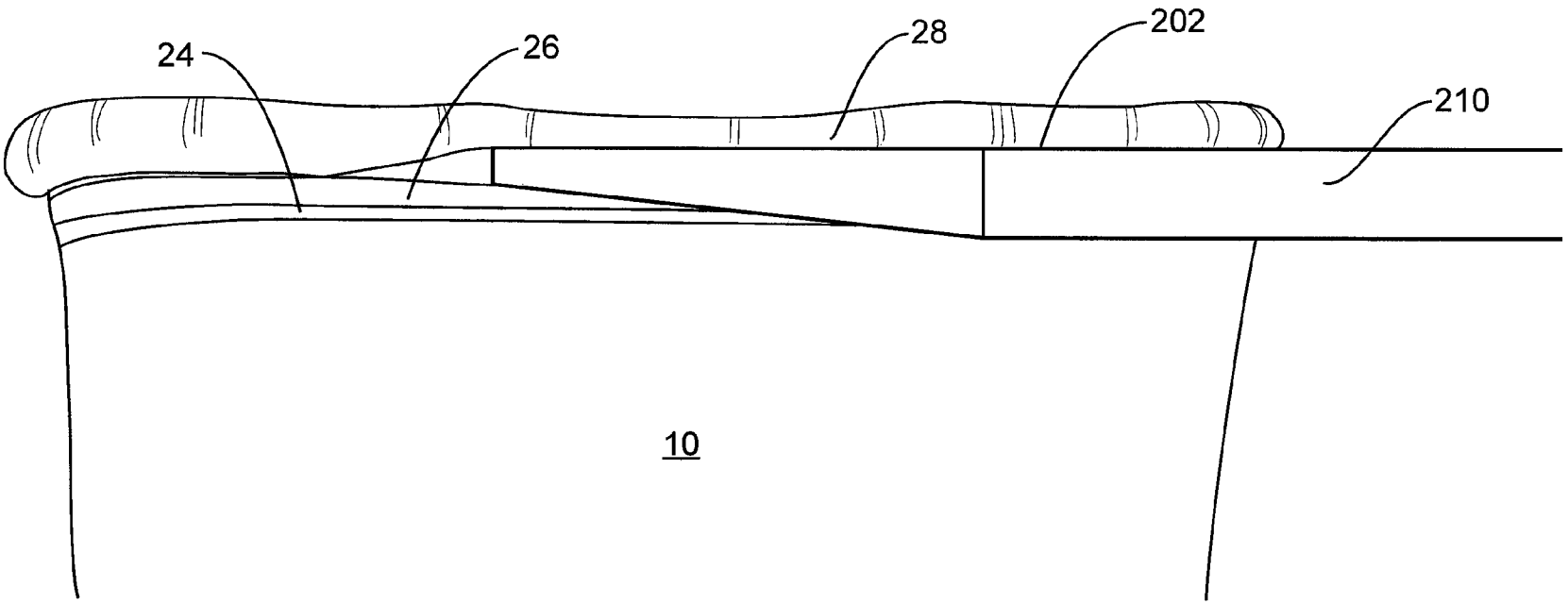
FIGS. 8A and 8B show side and top views of a hosiery article in a portion of a seaming machine.
Figure 8B:
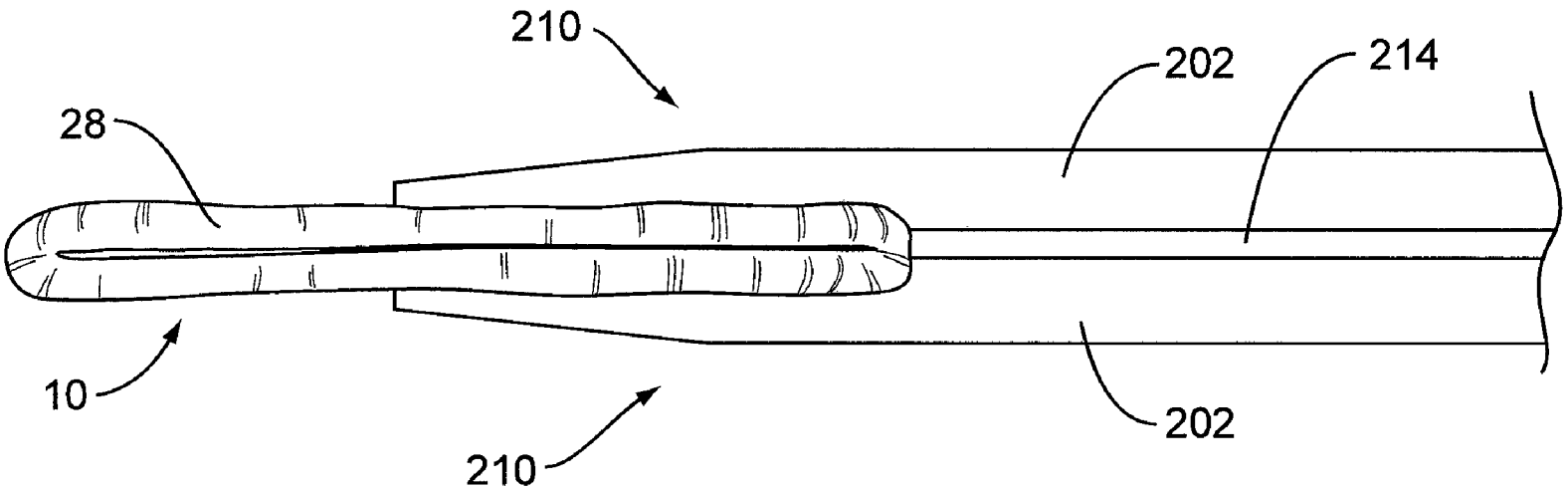

FIGS. 8A and 8B show the hosiery article 10 progressing through the guide bars 210 of a seaming machine 200. The first circumferential toe portion 24 is shown positioned below guide bars 210. The second circumferential toe portion 26 is within gap 214 so that toe clip 28 rests on the surface 202. The gap 214 is sufficient to receive the article of hosiery 10. The gap 214 may be between about 0.10 mm and about 1.5 mm. In an embodiment, the gap may be about 0.4 mm.

Figure 9A:
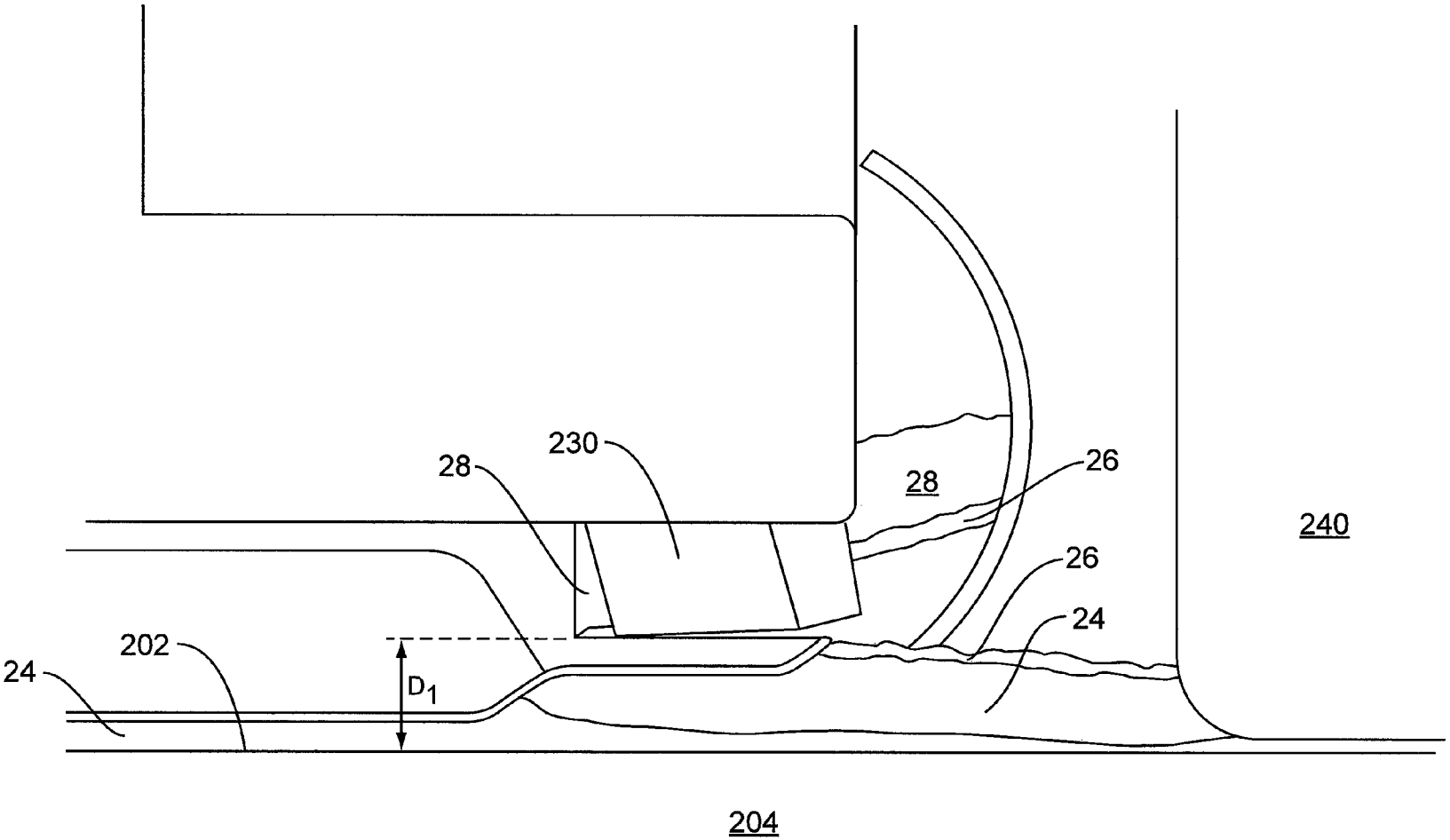
FIGS. 9A and 9B show side perspective views of a hosiery article at various stages of seam formation.

The toe clip 28, the second circumferential toe portion 26 and the first circumferential toe portion 24 is progressed past the feeder 220 positioned a distance above the surface 202. In alternate embodiments, the feeder 220 may be fixed above surface 202. In other alternate embodiments, the feeder 220 may float above surface 202. The toe clip 28 and the second circumferential toe portion 26 is then presented to the knife 230 as shown in FIG. 9A. The knife 230 is fixed at a distance, $D_1$, above the surface 202. The distance ($D_1$) may be between about 4.75 mm and 6.0 mm, preferably about 5.10 mm. The knife 230 cuts the second circumferential toe portion 26 removing toe clip 28 and leaving the first toe portion 24 on the surface 202. A portion of the second circumferential toe portion 26 may remain on the first circumferential toe portion 24 and the toe clip 28. In the embodiment shown, the knife 230 is fixed with hosiery article 10 as it progresses through the seaming machine 200.

Figure 9B:
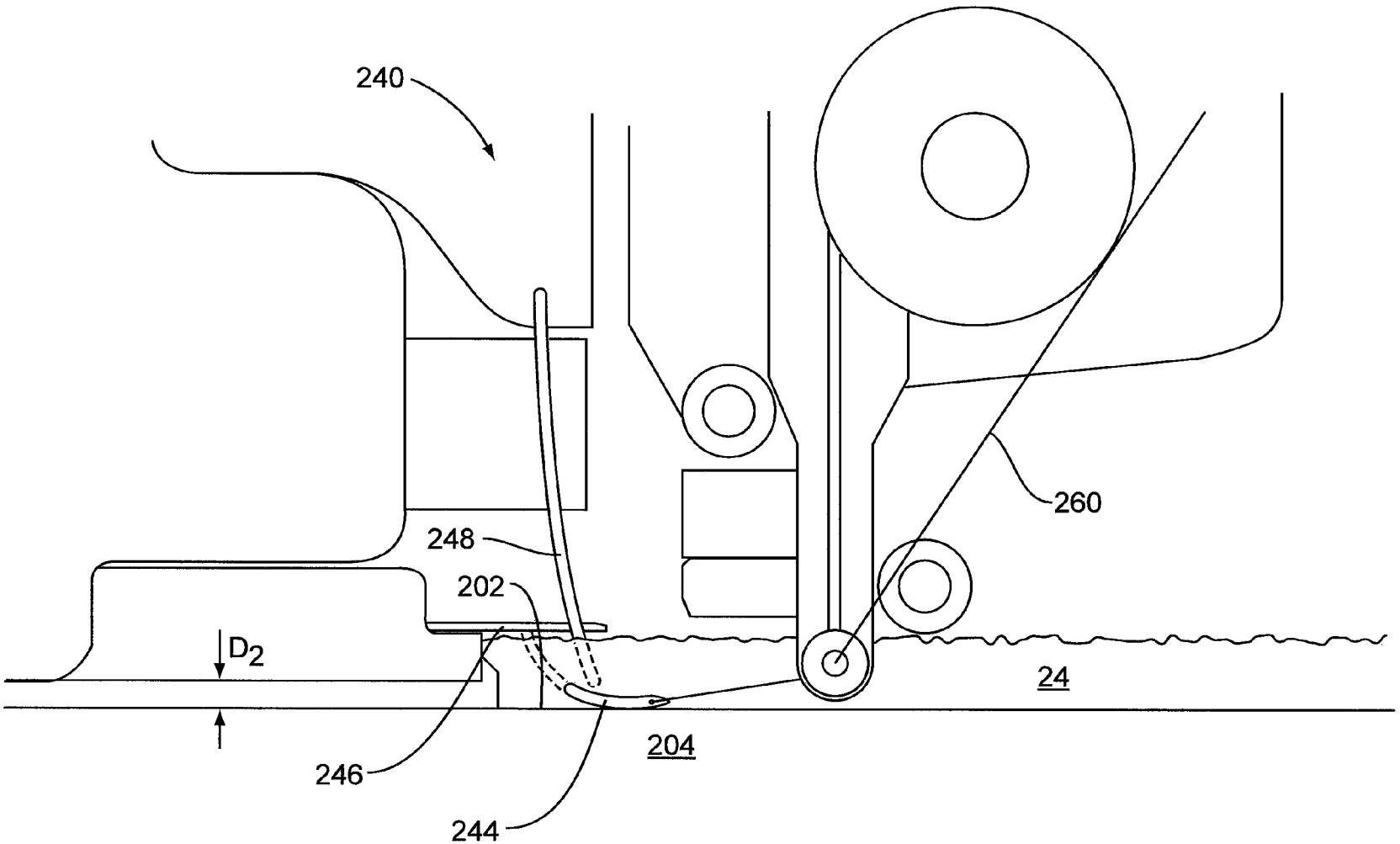

The first circumferential toe portion 24, is presented to the seaming head 240 as shown in FIG. 9B. Seaming head 240 may include first and second needles 244 and 248, a thread 260 and a tang element 246. The first seaming head 240 is fixed at a distance, $D_2$, above the surface 202. The distance $D_2$ may be between about 0.25 mm and 1.9 mm. In an embodiment, the distance $D_2$ is about 0.5 mm. The seaming thread 260 may be formed from a variety of yarn and fiber types. In an embodiment, the seaming thread 260 is a continuous multifilament yarn formed of polyamide, polyester, or polyolefin fibers. The seaming thread 260 may be textured and have some elasticity. The seaming thread may have a linear density between about 40 denier and about 100 denier, or an equivalent linear density if plied. In other embodiments, the seaming thread 260 may be a staple yarn formed from cotton fibers, or a blend of cotton and other fibers. The tang element 246 may have a size of 0.5, but can include all sizes.

In the embodiment shown in FIGS. 7 and 9B, the first seaming head 240 is fixed above the surface 202. Further, the second seaming head 250 is shown disengaged. In alternate embodiments, however, the first and second seaming heads 240 and 250 may be used to form the toe seam 20. The first seaming head 240 is configured to yield about 25 stitches per inch on the seam. In alternate embodiments, the seam stitches per inch may be more or less than 25.

Hosiery articles 10 are typically processed in bulk, bleached with a composition comprising water and a bleaching agent using a typical wet processing process. For example, the hosiery article 10 may be dyed and/or finished. The hosiery article 10 may then be dried in bulk and transferred to the seaming machine for formation of a toe seam 20.

In embodiments where the toe seam 20 is formed following knitting, the knit structure may be modified to accommodate the shrinkage typical of bleaching, dyeing and finishing operations. For example, the first circumferential toe portion 24 may have a smaller stitch length than would otherwise be used. In addition, the second circumferential toe portion 26 may have only two or three knitted courses.

Example 1

A knitted sock was formed having a leg, heel, upper and lower foot portions and a toe. An added course 22 was formed with cotton spun yarn having a linear density of 6/1 cc. The first yarn in the first circumferential toe portion 24 was formed using a ring spun yarn comprising 78% cotton and 20% polyester. The second yarn in the first circumferential toe portion was ring spun yarn comprising cotton fibers with a linear density of 10/1 cc. The second circumferential toe portion was knitted using a third yarn, a continuous filament polyester yarn, having a linear density of 1/150/68 den. The seaming machine was modified so that the feeder height was 1.10 mm above the support 204. The knife was fixed at first distance ($D_1$) of 5.10 mm above the surface 202 of the support 204. A single seaming head was fixed at a second distance ($D_2$) of 0.5 millimeters above the support 204. The seaming head was set to 25 stitches per inch and tang element having a size of 0.5 was used. The feed, knife and seaming heads were fixed above the surface 220. The burst strength was tested using ASTM D3786. The burst strength was 85, 102 and 119 psi and surpassed the minimum standard. The hosiery article 10 ruptured during each of the tests indicating a seam strength greater than the strength of the fabric.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A method of forming hosiery comprising:

knitting a foot portion;

knitting a first circumferential toe portion adjoined to the foot portion and having a first stitch length knitted with first and second yarns in a plaited relationship to create a first bulk along the first stitch length;

knitting a second circumferential toe portion adjacent the first circumferential toe portion, the second circumferential toe portion having at least two knitted courses, each of the at least two knitted courses having a second stitch length that is less than the first stitch length and a second bulk that is less than the first bulk;

knitting a toe clip adjacent the second circumferential toe portion to complete a hosiery blank, the toe clip and at least a portion of the second circumferential toe portion being removable;

removing the toe clip and at least a portion of the second circumferential toe portion;

stitching the first circumferential toe portion to form a toe seam.

2. The method of claim 1 further comprising knitting the second circumferential toe portion with at least three courses.

3. The method of claim 1 wherein the second circumferential toe portion is knitted with a third yarn.

4. The method of claim 1 wherein the third yarn is a non-elastomeric yarn.

5. An article of hosiery, comprising:

a foot portion comprising a plurality of knitted courses each having a first stitch length and a first bulk along the first stitch length;

a circumferential toe portion adjoined to the foot portion and having a second stitch length greater than the first stitch length and knitted with first and second yarns in a plaited relationship to create a second bulk that is greater than the first bulk;

at least one thread stitched in the circumferential toe portion forming a toe seam.

6. A knitted blank for forming an article of hosiery, comprising:

a foot portion;

a first circumferential toe portion adjoined to the foot portion and having a first stitch length knitted with first and second yarns in a plaited relationship to create a first bulk along the first stitch length;

a second circumferential toe portion adjacent the first circumferential toe portion, the second circumferential toe portion having at least two knitted courses, each of the at least two knitted courses having a second stitch length that is less than the first stitch length and a second bulk that is less than the first bulk; and a toe clip adjacent the second circumferential toe portion, the toe clip and at least a portion of the second circumferential toe portion being removable in preparation for forming a toe seam.

7. The knitted blank of claim 6 wherein the second circumferential toe portion has at least three knitted courses.

8. A method of forming a knitted blank for an article of hosiery, comprising:

knitting a foot portion;

knitting a first circumferential toe portion adjoined to the foot portion and having a first stitch length knitted with first and second yarns in a plaited relationship to create a first bulk along the first stitch length;

knitting a second circumferential toe portion adjacent the first circumferential toe portion, the second circumferential toe portion having at least two knitted courses, each of the at least two knitted courses having a second stitch length that is less than the first stitch length and a second bulk that is less than the first bulk; and knitting a toe clip adjacent the second circumferential toe portion to complete a hosiery blank, the toe clip and at least a portion of the second circumferential toe portion being removable in preparation for forming a toe seam.

9. The method of claim 8 further comprising knitting the second circumferential toe portion with at least three knitted courses.

10. The method of claim 8 wherein the second knitting step further comprises knitting the second circumferential toe portion with a third yarn.

11. The method of claim 8 wherein the third yarn is a non-elastomeric yarn.

* * * * *